US011680725B2

(12) United States Patent
Chen

(10) Patent No.: US 11,680,725 B2
(45) Date of Patent: Jun. 20, 2023

(54) MULTI-SPLIT AIR CONDITIONER, CONTROL METHOD AND DEVICE THEREOF, AND COMPUTER READABLE STORAGE MEDIUM

(71) Applicant: GD MIDEA AIR-CONDITIONING EQUIPMENT CO., LTD., Foshan (CN)

(72) Inventor: Junji Chen, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 63 days.

(21) Appl. No.: 17/285,171

(22) PCT Filed: Nov. 29, 2018

(86) PCT No.: PCT/CN2018/118036
§ 371 (c)(1),
(2) Date: Apr. 14, 2021

(87) PCT Pub. No.: WO2020/077749
PCT Pub. Date: Apr. 23, 2020

(65) Prior Publication Data

US 2021/0325075 A1 Oct. 21, 2021

(30) Foreign Application Priority Data

Oct. 15, 2018 (CN) ..... 201811201687.X

(51) Int. Cl.
*F24F 11/67* (2018.01)
*F24F 11/84* (2018.01)
(Continued)

(52) U.S. Cl.
CPC ..... *F24F 11/67* (2018.01); *F24F 1/0003* (2013.01); *F24F 11/84* (2018.01); *F24F 2110/10* (2018.01)

(58) Field of Classification Search
CPC ..... F24F 11/67; F24F 11/84; F24F 2110/10
(Continued)

(56) References Cited

U.S. PATENT DOCUMENTS 5,775,581 A * 7/1998 Welden ..... F24D 12/02 237/61
2006/0185373 A1 8/2006 Butler et al.
2010/0174414 A1* 7/2010 Takagi ..... F24F 11/30 700/278
2012/0006436 A1* 1/2012 Morimoto ..... F16K 11/085 137/625

FOREIGN PATENT DOCUMENTS

CN 1170855 A 1/1998
CN 1987239 A 6/2007
(Continued)

OTHER PUBLICATIONS

World Intellectual Property Organization (WIPO) International Search Report and Written Opinion for PCT/CN2018/118036 with translation dated Jul. 8, 2019 12 Pages.
(Continued)

*Primary Examiner* — Jigneshkumar C Patel
(74) *Attorney, Agent, or Firm* — Anova Law Group PLLC

(57) ABSTRACT

A control method includes, after a multi-split air conditioner starts to operate in a heating mode, determining a target room from a plurality of rooms for which the multi-split air conditioner provides air conditioning, obtaining an indoor temperature of the target room, determining whether the indoor temperature of the target room is greater than a target temperature corresponding to the target room, and, in
(Continued)

response to a determination that the indoor temperature of the target room is greater than the target temperature, controlling the multi-split air conditioner to switch an operation mode of a target indoor unit corresponding to the target room from the heating mode to a cooling mode.

15 Claims, 3 Drawing Sheets

(51) Int. Cl.
*F24F 1/0003* (2019.01)
*F24F 110/10* (2018.01)

(58) Field of Classification Search
USPC ..... 700/276
See application file for complete search history.

(56) References Cited

FOREIGN PATENT DOCUMENTS

| | | | | | |
|---|---|---|---|---|---|
| CN | 101464026 | A | * | 6/2009 | ..... F24F 11/30 |
| CN | 101464026 | A | | 6/2009 | |
| CN | 104214893 | A | | 12/2014 | |
| CN | 104482633 | A | | 4/2015 | |
| CN | 104748317 | A | | 7/2015 | |
| CN | 106352484 | A | | 1/2017 | |
| CN | 104214893 | B | * | 2/2017 | |
| CN | 106403183 | A | | 2/2017 | |
| CN | 106545971 | A | | 3/2017 | |
| CN | 107289590 | A | | 10/2017 | |
| CN | 108105857 | A | | 6/2018 | |
| CN | 207702670 | U | | 8/2018 | |
| CN | 108489016 | A | | 9/2018 | |
| EP | 2733441 | A2 | | 5/2014 | |
| JP | 2013072619 | A | | 4/2013 | |
| KR | 20080012516 | A | | 2/2008 | |
| KR | 20130107838 | A | | 10/2013 | |

OTHER PUBLICATIONS

The State Intellectual Property Office of PRC (SIPO) the First Office Action for CN Application No. 201811201687.X dated Sep. 10, 2019 25 Pages (Translation Included ).

The State Intellectual Property Office of PRC (SIPO) the Second Office Action for CN Application No. 201811201687.X dated Feb. 28, 2020 17 Pages (Translation Included ).

* cited by examiner

MULTI-SPLIT AIR CONDITIONER, CONTROL METHOD AND DEVICE THEREOF, AND COMPUTER READABLE STORAGE MEDIUM

CROSS-REFERENCE TO RELATED APPLICATIONS

The present application is a National Stage Entry under 35 U.S.C. § 371 of International Application No. PCT/CN2018/118036, filed on Nov. 29, 2018, which claims priority to Chinese Patent Application No, 201811201687.X, filed on Oct. 15, 2018 and entitled "MULTI-SPLIT AIR CONDITIONER, CONTROL METHOD AND DEVICE THEREOF, AND COMPUTER READABLE STORAGE MEDIUM," the entire content of which is incorporated herein by reference.

TECHNICAL FIELD

The present application relates to the technical field of air conditioners, in particular to a multi-split air conditioner, a control method and device thereof, and a computer readable storage medium.

BACKGROUND

A multi-split air conditioner has an outdoor unit and multiple indoor units.

In the exemplary technology, when a multi-split air conditioner is heating, it heats all the rooms where indoor units are located, but cannot only heat the room where a specific indoor unit is located. As such, when the room where a certain indoor unit is located reaches the set temperature ahead of time, but the temperature of the rooms where other indoor units are located have not reached the set temperature, the multi-split air conditioner will continue to heat. As a result, the temperature of the room having reached the set temperature continues to rise, and the heating of the multi-split air conditioner is unreasonable.

SUMMARY

The main purpose of the present application is to provide a multi-split air conditioner, a control method and device thereof, and a computer readable storage medium, to solve the problem of unreasonable heating of the multi-split air conditioner.

In order to achieve the above purpose, the application provides a control method of a multi-split air conditioner, the control method of a multi-split air conditioner includes the following operations:

determining a target room in an action space of the multi-split air conditioner, and obtaining an indoor temperature of the target room, after the multi-split air conditioner enters a heating mode;

determining whether the indoor temperature of the target room is greater than the target temperature corresponding to the target room;

determining the target room with the indoor temperature greater than the target temperature as a room for cooling, in response to a determination that the indoor temperature of the target room is greater than the target temperature, and controlling the multi-split air conditioner to switch an operation mode of an indoor unit corresponding to the room for cooling from the heating mode to a cooling mode.

In one embodiment, the operation of determining the target room in the action space of the multi-split air conditioner includes:

detecting whether a detection room is preset in the multi-split air conditioner;

determining the detection room as a target room in response to a determination that the detection room is preset;

determining all rooms in the active space of the multi-split air conditioner as target rooms, in response to a determination that no detection room is preset.

In one embodiment, the operations of controlling the multi-split air conditioner to switch the operating mode of the indoor unit corresponding to the room for cooling from the heating mode to the cooling mode includes:

determining a target indoor unit corresponding to the room for cooling;

controlling the multi-split air conditioner to stop heating, and controlling a refrigeration valve of the target indoor unit to open and refrigeration valves of other indoor units to close;

controlling the multi-split air conditioner to start the cooling mode to cool the room for cooling.

In one embodiment, the operations of controlling the multi-split air conditioner to switch the operating mode of the indoor unit corresponding to the room for cooling from the heating mode to the cooling mode includes:

generating a cooling start instruction corresponding to the room for cooling;

sending the cooling start instruction to the multi-split air conditioner, wherein the multi-split air conditioner stops heating upon receiving the cooling start instruction, opens the refrigeration valve of the indoor unit corresponding to the room for cooling and closes the refrigeration valves of the other indoor units, so as to start the cooling mode to cool the room for cooling.

In one embodiment, before determining that the indoor temperature is greater than the target temperature corresponding to the target room, the method further includes:

obtaining a set temperature for the target room set by a user;

determining the target temperature according to the set temperature, wherein the target temperature is greater than the set temperature.

In one embodiment, the operation of determining the target temperature according to the set temperature includes:

obtaining an offset;

obtaining the target temperature by calculating a sum of the set temperature and the offset.

In one embodiment, after the operation of controlling the multi-split air conditioner to switch the operating mode of the indoor unit corresponding to the room for cooling from the heating mode to the cooling mode, the control method of a multi-split air conditioner further includes:

determining whether a current indoor temperature in the room for cooling is lower than a set temperature every preset time interval;

calculating a difference between the set temperature and the current indoor temperature in response to a determination that the current indoor temperature is lower than the set temperature;

controlling the multi-split air conditioner to switch from the cooling mode to the heating mode in response to a determination that the difference is greater than a preset difference, so as to heat up each room where an indoor unit is located.

In one embodiment, the preset difference is based on a heating rate of the target room, the set temperature corresponding to the target room, a heating rate of a room with a lowest temperature, a set temperature corresponding to the room with the lowest temperature, and a current temperature of the room with the lowest temperature.

In one embodiment, the control method of a multi-split air conditioner further includes:

after the multi-split air conditioner enters the heating mode, obtaining an indoor temperature of each room in the action space of the multi-split air conditioner, and determining whether the indoor temperature of each room is greater than or equal to a set temperature corresponding to the room;

if not, performing the operation of determining a target room in an action space of the multi-split air conditioner.

In one embodiment, after the operation of determining that the indoor temperature of each room is greater than or equal to the corresponding set temperature of the room, the control method of a multi-split air conditioner further includes:

controlling the multi-split air conditioner to stop heating in response to a determination that the indoor temperature of each room is greater than or equal to the set temperature corresponding to the room.

In one embodiment, the refrigeration valve of each indoor unit of the multi-split air conditioner can be individually closed and individually opened, and the heating valves of various indoor units of the multi-split air conditioner are simultaneously closed and simultaneously opened.

To realize the purpose above, the present disclosure further provides a control device of a multi-split air conditioner, the control device of the multi-split air conditioner includes:

a determination module for determining a target room in an active space of the multi-split air conditioner after the multi-split air conditioner enters a heating mode, and obtaining an indoor temperature of the target room;

a judgment module for determining whether the indoor temperature of the target room is greater than a target temperature corresponding to the target room;

wherein the determination module is further for determining the target room greater than the target temperature as a room for cooling in response to a determination that the indoor temperature of the target room is greater than the target temperature, and controlling the multi-split air conditioner to switch an operation mode of an indoor unit corresponding to the room for cooling from the heating mode to a cooling mode.

To realize the purpose above, the present disclosure further provides a control device of a multi-split air conditioner, the control device of the multi-split air conditioner includes a processor, a memory and a control program of a multi-split air conditioner stored on the memory for being run on the processor, the control program of the multi-split air conditioner is executed by the processor to achieve following operations:

determining a target room in an action space of the multi-split air conditioner, and obtaining an indoor temperature of the target room, after the multi-split air conditioner enters a heating mode;

determining whether the indoor temperature of the target room is greater than the target temperature corresponding to the target room;

determining the target room with the indoor temperature greater than the target temperature as a room for cooling, in response to a determination that the indoor temperature of the target room is greater than the target temperature, and controlling the multi-split air conditioner to switch an operation mode of an indoor unit corresponding to the room for cooling from the heating mode to a cooling mode.

To realize the purpose above, the present disclosure further provides a multi-split air conditioner, the multi-split air conditioner includes a processor, a memory and a control program of the multi-split air conditioner stored on the memory and running on the processor, the following operations are implemented in response to a determination that the control program of the multi-split air conditioner is executed by the processor:

determining a target room in an action space of the multi-split air conditioner, and obtaining an indoor temperature of the target room, after the multi-split air conditioner enters a heating mode;

determining whether the indoor temperature of the target room is greater than the target temperature corresponding to the target room;

determining the target room with the indoor temperature greater than the target temperature as a room for cooling, in response to a determination that the indoor temperature of the target room is greater than the target temperature, and controlling the multi-split air conditioner to switch an operation mode of an indoor unit corresponding to the room for cooling from the heating mode to a cooling mode.

To realize the purpose above, the present disclosure further provides a computer readable storage medium, the computer readable storage medium stores a multi-split air conditioner control program, the control program of the multi-split air conditioner is executed by the processor to achieve the following operations:

determining a target room in an action space of the multi-split air conditioner, and obtaining an indoor temperature of the target room, after the multi-split air conditioner enters a heating mode;

determining whether the indoor temperature of the target room is greater than the target temperature corresponding to the target room;

determining the target room with the indoor temperature greater than the target temperature as a room for cooling, in response to a determination that the indoor temperature of the target room is greater than the target temperature, and controlling the multi-split air conditioner to switch an operation mode of an indoor unit corresponding to the room for cooling from the heating mode to a cooling mode.

The one or more technical solutions provided in the embodiments of the present application have at least the following technical effects or advantages:

When a multi-split air conditioner is heating, a target room with an overly high temperature is cooled, so that an indoor temperature in the target room is reduced, it solves the problem of "the multi-split air conditioner continues to heat the room that reaches the set temperature, resulting in the room temperature being too high" in the exemplary technology, and the multi-split air conditioner can reasonably heat each room, avoiding the problem of high temperature in a room.

The realization of purposes, functional characteristics and advantages of the present application will be further described with reference to the drawings in conjunction with the embodiments.

DETAILED DESCRIPTION OF THE EMBODIMENTS

It should be understood that the specific embodiments described herein are only used to explain the application, and are not to limit the application.

The main solution of the embodiments of the present application is: after a multi-split air conditioner enters a heating mode, determining a target room in an action space of the multi-split air conditioner, and obtaining an indoor temperature of the target room; determining whether the indoor temperature of the target room is greater than a target temperature corresponding to the target room, determining the target room with the indoor temperature greater than the target temperature as a room for cooling, in response to a determination that the indoor temperature of the target room is greater than the target temperature, and controlling the multi-split air conditioner to switch an operation mode of the indoor unit corresponding to the room for cooling from the heating mode to a cooling mode.

When the temperature of the target room is greater than the target temperature, the multi-split air conditioner switches from the heating mode to the cooling mode to cool the target room, so that the temperature of the target room is reduced, the problem that the temperature of a certain room is too high due to the simultaneous heating of multiple rooms by the multi-split air conditioner is avoided, and the multi-split air conditioner can reasonably heat each room.

Figure 1:
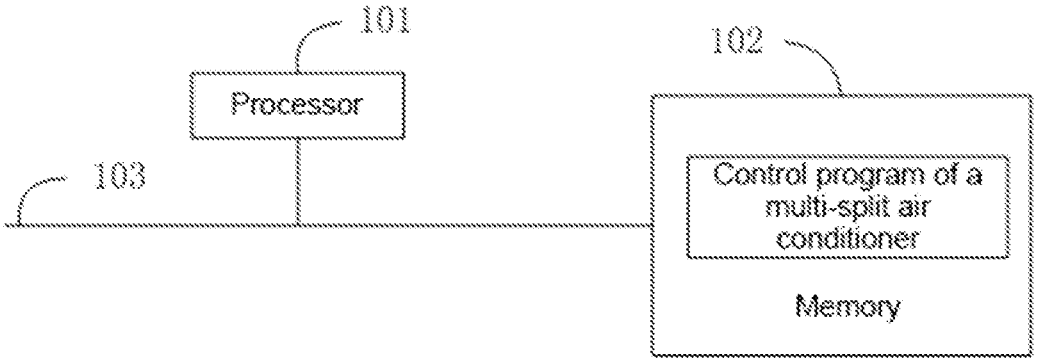
FIG. 1 is a diagram of a hardware structure of a multi-split air conditioner involved in the embodiments of the present application.

As an embodiment, the multi-split air conditioner can be shown in FIG. 1.

The solution of the embodiments of the present application relates to a multi-split air conditioner. The multi-split air conditioner includes: a processor 101, such as a CPU, a memory 102, and a communication bus 103. In particular, the communication bus 103 is configured to realize the connection and communication between these components.

The memory 102 can be a high-speed RAM memory or a stable memory (non-volatile memory), such as a disk memory. As shown in FIG. 1, the memory 102 as a computer storage medium may include a control program of a multi-split air conditioner, and the processor 101 may be configured to call the control program of a multi-split air conditioner stored in the memory 102, and implement the following:

after the multi-split air conditioner enters a heating mode, determining a target room in an action space of the multi-split air conditioner, and obtaining an indoor temperature of the target room;

determining whether the indoor temperature of the target room is greater than a target temperature corresponding to the target room;

determining the target room with the indoor temperature greater than the target temperature as a room for cooling, in response to a determination that the indoor temperature of the target room is greater than the target temperature, and controlling the multi-split air conditioner to switch an operation mode of an indoor unit corresponding to the room for cooling from the heating mode to a cooling mode.

Further, the processor 101 can be configured to call the control program of a multi-split air conditioner stored in the memory 102 and perform the following operations:

detecting whether a detection room is preset in the multi-split air conditioner;

determining the detection room as the target room in response to a determination that the detection room is preset;

determining all rooms in the active space of the multi-split air conditioner as target rooms, in response to a determination that no detection room is preset.

Further, the processor 101 can be configured to call the control program of a multi-split air conditioner stored in the memory 102 and perform the following operations:

determining a target indoor unit corresponding to the room for cooling;

controlling the multi-split air conditioner to stop heating, and controlling a refrigeration valve of the target indoor unit to open and refrigeration valves of other indoor units to close;

controlling the multi-split air conditioner to start the cooling mode to cool the room for cooling.

Further, the processor 101 can be configured to call the control program of a multi-split air conditioner stored in the memory 102 and perform the following operations:

generating a cooling start instruction corresponding to the room for cooling;

sending the cooling start instruction to the multi-split air conditioner, where the multi-split air conditioner stops heating upon receiving the cooling start instruction, opens the refrigeration valve of the indoor unit corresponding to the room for cooling and closes the refrigeration valves of the other indoor units, so as to start the cooling mode to cool the room for cooling.

Further, the processor 101 can be configured to call the control program of a multi-split air conditioner stored in the memory 102 and perform the following operations:

obtaining a set temperature for the target room set by a user;

determining a target temperature according to the set temperature, where the target temperature is greater than the set temperature.

Further, the processor 101 can be configured to call the control program of a multi-split air conditioner stored in the memory 102 and perform the following operations:

determining whether a current indoor temperature in the room for cooling is lower than the set temperature every preset time interval;

calculating a difference between the set temperature and the current indoor temperature in response to a determination that the current indoor temperature is lower than the set temperature;

controlling the multi-split air conditioner to switch from the cooling mode to the heating mode in response to a determination that the difference is greater than a preset difference, so as to heat up each room where an indoor unit is located.

According to the above scheme, in this embodiment, when the multi-split air conditioner is heating, the target room with an overly high temperature is cooled, so that the indoor temperature in the target room is reduced, thus the problem of "the multi-split air conditioner continues to heat the room that reaches the set temperature, resulting in the room temperature being too high" in the exemplary technology is solved, and the multi-split air conditioner can reasonably heat each room, avoiding the problem of high temperature in a room.

Based on a hardware architecture of the above-mentioned multi-split air conditioner, an embodiment of a control method of a multi-split air conditioner is proposed.

Figure 2:
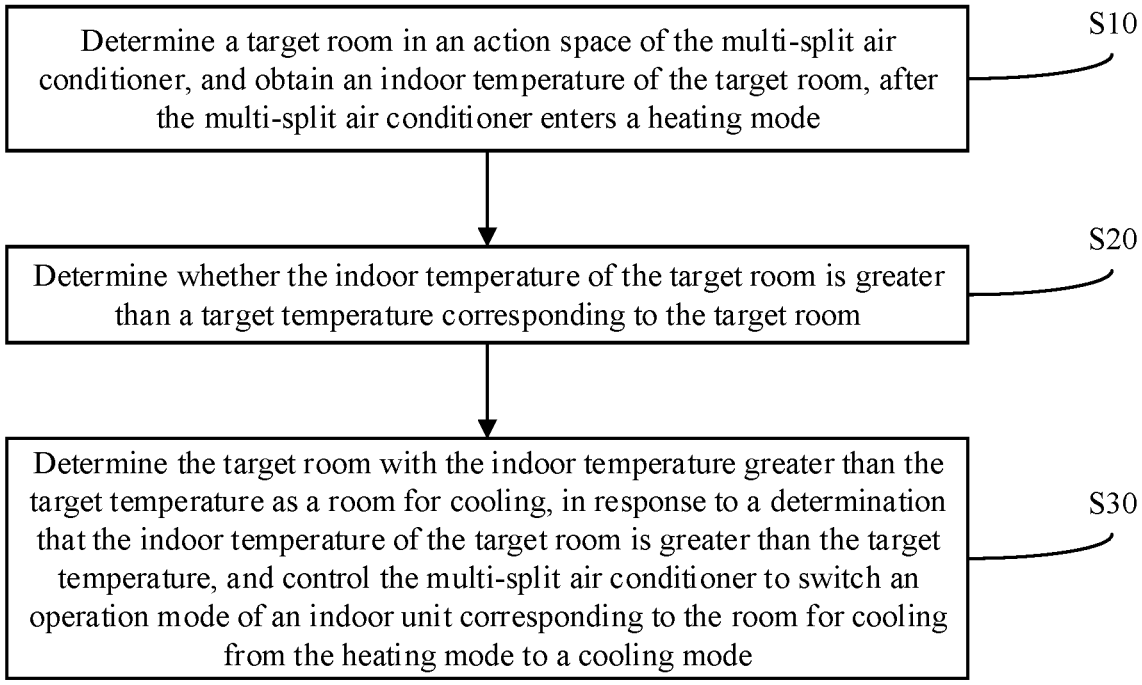
FIG. 2 is a flow diagram of a first embodiment of a control method of a multi-split air conditioner of the present application.

FIG. 2 is a first embodiment of the control method of the multi-split air conditioner of the present application, and the control method of the multi-split air conditioner includes the following operations:

Operation S10, determining a target room in an action space of the multi-split air conditioner, and obtaining an indoor temperature of the target room, after the multi-split air conditioner enters a heating mode.

The multi-split air conditioner includes an outdoor unit and multiple indoor units. For reasons such as a heating pipeline valve of the multi-split air conditioner cannot be completely closed, the multi-split air conditioner can only simultaneously heat the rooms where the indoor units are located. However, due to differences in space and sealing condition among different rooms, indoor temperatures of some rooms rise faster and indoor temperatures of some rooms rise slower. As a result, the room with faster temperature increase reaches a heating temperature set by a user earlier. However, since a temperature of a room with slower heating has not reached the set temperature, the multi-split air conditioner will continue to heat up. As a result, a temperature of the room that has reached the set temperature continues to rise, causing the temperature of the room to be too high, which will make the user of the room feel too hot. If the user of the room turns off the heating mode of the multi-split air conditioner, because the temperatures of other rooms have not reached the set temperature, the user of the other rooms will feel too cold. As such, heating of the multi-split air conditioner is unreasonable.

In the present application, when the multi-split air conditioner is in the heating mode, in each room corresponding to the multi-split air conditioner, there will be a room whose indoor temperature has not reached the set temperature of the room. It can be understood that, when the indoor temperatures of all the room reach the corresponding set temperatures, the multi-split air conditioner stops heating. The target room can be set by the user. The user can set a main room, that is, a detection room for the multi-split air conditioner, and the detection room is the target room. When the user does not set up a detection room, rooms where the indoor units are located are the target rooms.

Operation S20, determining whether the indoor temperature of the target room is greater than a target temperature corresponding to the target room;

Operation S30, determining the target room with the indoor temperature greater than the target temperature as a room for cooling, in response to a determination that the indoor temperature of the target room is greater than the target temperature, and controlling the multi-split air conditioner to switch an operation mode of an indoor unit corresponding to the room for cooling from the heating mode to a cooling mode.

After the multi-split air conditioner obtains the indoor temperature of each target room, the multi-split air conditioner determines whether the indoor temperature of the target room is greater than the target temperature corresponding to the target room, and if the indoor temperature of the target room is greater than the target temperature corresponding to the target room, it is determined that the temperature of the target room is too high, in this scenario, the target room is determined, by the multi-split air conditioner, as a room for cooling to have the temperature reduced. Specifically, after determining that the temperature of the target room is greater than the target temperature corresponding to the target room, the multi-split air conditioner stops heating, to take the target room as a room for cooling, and then controls the refrigeration valve of the target indoor unit corresponding to the room for cooling to open, and the refrigeration valves of other indoor units to close, and then starts the cooling mode, so as to cool down the room for cooling, so that the temperature of the room for cooling will not be too high. In addition, the target temperature is obtained according to the heating temperature set by a user. Specifically, the multi-split air conditioner obtains the set temperature set by the user for the target room, that is, obtains the heating temperature, the target temperature is obtained by adding an offset temperature to the set temperature. The target temperature is greater than the set temperature. The offset temperature can be any suitable value, such as 3° C.

Further, after the multi-split air conditioner cools the room for cooling, the multi-split air conditioner determines whether the current indoor temperature of the room for cooling is lower than the set temperature every preset time interval, and if the current indoor temperature of the room for cooling is lower than the set temperature, then a difference between the set temperature and the current indoor temperature is calculated, and the difference is a positive number. If the difference is greater than the preset difference, the room for cooling can be heated together with the other rooms again to ensure that when the multi-split air conditioner is heating, the temperature of the target room will not be higher than the target temperature again. It is understandable that the preset difference can be set according to the temperature of other rooms. For example, when the multi-split air conditioner stops heating, the room with the lowest temperature is determined, a heating rate of the room can be obtained according to a heating time of the multi-split air conditioner, an initial temperature in the room and a current temperature in the room. Similarly, the heating rate of the cooling target room can further be obtained. Thus, the multi-split air conditioner can obtain the temperature by which the cooling target room needs to be reduced, based on a heating rate of the lowest temperature room, a heating rate of the cooling target room, the current temperature of the lowest temperature room and the set temperatures of the two rooms, thereby obtaining an offset of the cooling, that is, the preset difference. For example, the heating rate of the target room is 1° C./min. The heating rate of the room with the lowest temperature is 0.8° C./min, set temperatures of the two rooms are both 25° C., and the current temperature of the room with the lowest temperature is 20° C., then, an offset should be (25° C.−20° C.)÷0.8° C./min×1° C./min=6.25° C., that is, the temperature of the room for cooling should be reduced to 18.75° C. The above are all theoretical calculations. If the offset is too large, the temperature of the room for cooling will inevitably be too low. In this scenario, a maximum offset can be limited, and the maximum offset can be limited to 7° C.

When the difference between the temperature of the room for cooling and the set temperature is greater than or equal to the preset difference, the multi-split air conditioner starts the heating mode again to heat each room.

All of the above are described with the multi-split air conditioner being the execution body. In the present application, the executing body may be a server connected to the multi-split air conditioner or a control terminal connected to the multi-split air conditioner. When the execution subject is the server or the control terminal, the multi-split air conditioner will upload the indoor temperature of each target room during heating and the set temperature of each room to the server or the control terminal in real time or regularly, the server or the control terminal determines whether the indoor temperature of the target room (the server and the control terminal store the detection room set by the user) is greater than the target temperature, if the indoor temperature of the target room is greater than the target temperature, the server or the control terminal will determine the target room as a room for cooling, then generate a cooling start instruction corresponding to the room for cooling, and send the cooling start instruction to a multi-split air conditioner. After receiving the cooling start instruction, the multi-split air conditioner stops heating first, then determines the indoor unit corresponding to the room for cooling, and opens the refrigeration valve of the indoor unit and closes the refrigeration valves of other indoor units, and finally, starts the cooling mode to cool the room for cooling.

In the technical solution provided by this embodiment, when the multi-split air conditioner is heating, the target room whose temperature is too high is cooled, so that the indoor temperature in the target room is reduced, solving the problem of "the multi-split air conditioner continues to heat the room that reaches the set temperature, resulting in the room temperature being too high" in the exemplary technology, and the multi-split air conditioner can reasonably heat each room, avoiding the problem of high temperature in a room.

Figure 3:
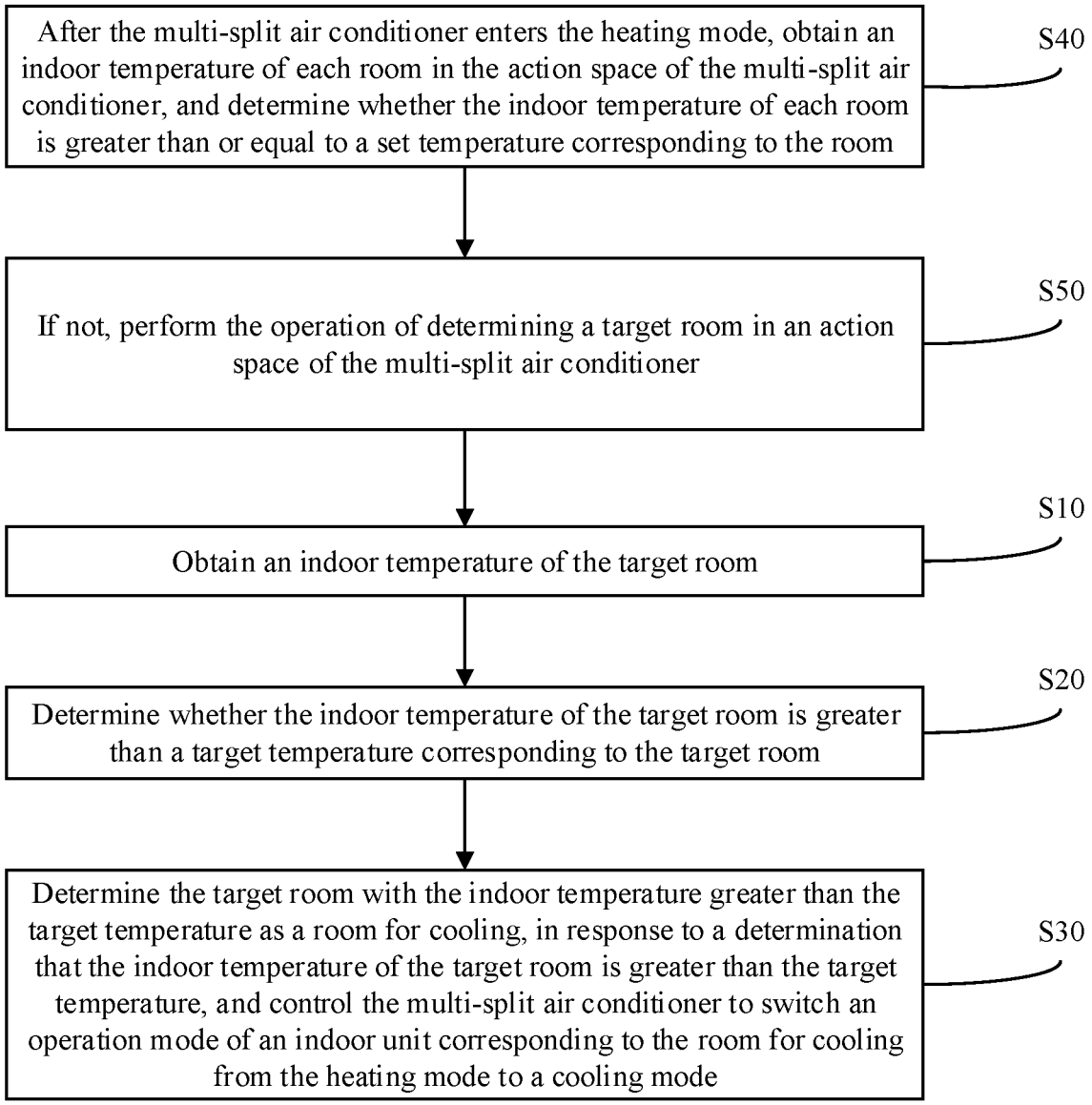
FIG. 3 is a flow diagram of a second embodiment of the control method of the multi-split air conditioner of the present application.

Referring to FIG. 3, which shows a second embodiment of the control method of the multi-split air conditioner, based on the first embodiment, the control method of the multi-split air conditioner, further includes:

Operation S40, after the multi-split air conditioner enters the heating mode, obtaining an indoor temperature of each room in the action space of the multi-split air conditioner, and determining whether the indoor temperature of each room is greater than or equal to a set temperature corresponding to the room;

Operation S50, if not, performing the operation of determining a target room in an action space of the multi-split air conditioner;

After the multi-split air conditioner starts heating, the indoor temperature of each room will reach the set temperature. In this scenario, the multi-split air conditioner will stop heating, that is, the temperature of the room that exceeds the target temperature will not continue to rise, and there is no need to cool the room that exceeds the target temperature. It can be understood that only when the indoor temperature of a room does not reach the set temperature, the multi-split air conditioner will perform operations S10 to S30.

Based on this, after the multi-split air conditioner enters the heating mode, the multi-split air conditioner obtains the indoor temperature of each room, and then determines whether the temperature of each room is greater than or equal to the corresponding set temperature of the room, if an indoor temperature is lower than the corresponding set temperature, there is a possibility that a certain room has reached the set temperature and will continue to rise. In this scenario, the multi-split air conditioner determines the target room, to determine whether the indoor temperature of the target room is greater than the target temperature, and cool the target room when the indoor temperature of the target room is greater than the target temperature; if the temperatures of all rooms are greater than the corresponding set temperatures, the multi-split air conditioner stops heating.

In the technical solution provided in this embodiment, after obtaining the indoor temperature of each room, the multi-split air conditioner determines whether the temperature of each room is greater than or equal to the corresponding set temperature, if not, determines whether the indoor temperature of the target room is greater than the target temperature, so that the multi-split air conditioner can avoid the situation that the temperature of the target room is too high.

The present application further provides a control device for a multi-split air conditioner.

Figure 4:
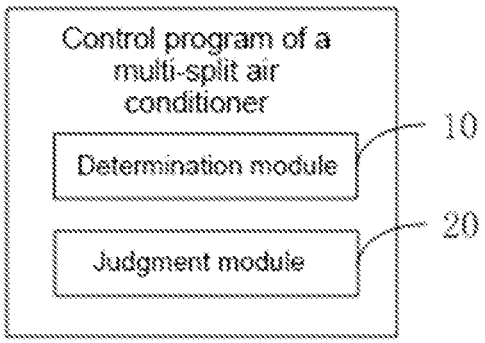
FIG. 4 is a first schematic functional module diagram of a control device of a multi-split air conditioner of the application.

FIG. 4 is a first schematic functional module diagram of a control device of a multi-split air conditioner. The control device of the multi-split air conditioner includes determination module 10 and a judgment module 20.

The determination module 10 is configured to, after the multi-split air conditioner enters the heating mode, determine a target room in an action space of the multi-split air conditioner, and obtain an indoor temperature of the target room.

The multi-split air conditioner includes an outdoor unit and multiple indoor units. For reasons such as a heating pipeline valve of the multi-split air conditioner cannot be completely closed, the multi-split air conditioner can only simultaneously heat the rooms where the indoor units are located. However, due to differences in space and sealing condition among different rooms, indoor temperatures of some rooms rise faster and indoor temperatures of some rooms rise slower. As a result, the room with faster temperature increase reaches a heating temperature set by a user earlier. However, since a temperature of a room with slower heating has not reached the set temperature, the multi-split air conditioner will continue to heat up. As a result, a temperature of the room that has reached the set temperature continues to rise, causing the temperature of the room to be too high, which will make the user of the room feel too hot. If the user of the room turns off the heating mode of the multi-split air conditioner, because the temperatures of other rooms have not reached the set temperature, the user of the other rooms will feel too cold. As such, heating of the multi-split air conditioner is unreasonable.

In the present application, when the multi-split air conditioner is in the heating mode, in each room corresponding to the multi-split air conditioner, there will be a room whose indoor temperature has not reached the set temperature of the room. It can be understood that, when the indoor temperatures of all the room reach the corresponding set temperatures, the multi-split air conditioner stops heating. The target room can be set by the user. The user can set a main room, that is, a detection room for the multi-split air conditioner, and the detection room is the target room. When the user does not set up a detection room, rooms where the indoor units are located are the target rooms.

The judgment module 20 is configured to determine whether the indoor temperature of the target room is greater than a target temperature corresponding to the target room;

the determination module 10 is also configured to determine the target room greater than the target temperature as a room for cooling, in response to a determination that the indoor temperature of the target room is greater than the target temperature, and control the multi-split air conditioner to switch an operation mode of an indoor unit corresponding to the room for cooling from the heating mode to a cooling mode.

After the multi-split air conditioner obtains the indoor temperature of each target room, the judgment module 20 will determine that the indoor temperature of the target room is greater than the target temperature corresponding to the target room, if the indoor temperature of the target room is greater than the target temperature, the temperature of the target room is too high. In this scenario, the target room is determined, by the multi-split air conditioner, as a room for cooling to have the temperature reduced. Specifically, after determining that the temperature of the target room is greater than the target temperature corresponding to the target room, the multi-split air conditioner stops heating, to take the target room as a room for cooling, and then controls the refrigeration valve of the target indoor unit corresponding to the room for cooling to open, and the refrigeration valves of other indoor units to close, and then starts the cooling mode, so as to cool down the room for cooling, so that the temperature of the room for cooling will not be too high. In addition, the target temperature is obtained according to the heating temperature set by a user. Specifically, the multi-split air conditioner obtains the set temperature set by the user for the target room, that is, obtains the heating temperature, the target temperature is obtained by adding an offset temperature to the set temperature. The target temperature is greater than the set temperature. The offset temperature can be any suitable value, such as 3° C.

Further, after the multi-split air conditioner cools the room for cooling, the multi-split air conditioner determines whether the current indoor temperature of the room for cooling is lower than the set temperature every preset time interval, and if the current indoor temperature of the room for cooling is lower than the set temperature, then a difference between the set temperature and the current indoor temperature is calculated, and the difference is a positive number. If the difference is greater than the preset difference, the room for cooling can be heated together with the other rooms again to ensure that when the multi-split air conditioner is heating, the temperature of the target room will not be higher than the target temperature again. It is understandable that the preset difference can be set according to the temperature of other rooms. For example, when the multi-split air conditioner stops heating, the room with the lowest temperature is determined, a heating rate of the room can be obtained according to a heating time of the multi-split air conditioner, an initial temperature in the room and a current temperature in the room. Similarly, the heating rate of the cooling target room can further be obtained. Thus, the multi-split air conditioner can obtain the temperature by which the cooling target room needs to be reduced, based on a heating rate of the lowest temperature room, a heating rate of the cooling target room, the current temperature of the lowest temperature room and the set temperatures of the two rooms, thereby obtaining an offset of the cooling, that is, the preset difference. For example, the heating rate of the target room is 1° C./min. The heating rate of the room with the lowest temperature is 0.8° C./min, set temperatures of the two rooms are both 25° C., and the current temperature of the room with the lowest temperature is 20° C., then, an offset should be (25° C.−20° C.)÷0.8° C./min×1° C./min=6.25° C., that is, the temperature of the room for cooling should be reduced to 18.75° C. The above are all theoretical calculations. If the offset is too large, the temperature of the room for cooling will inevitably be too low. In this scenario, a maximum offset can be limited, and the maximum offset can be limited to 7° C.

When the difference between the temperature of the room for cooling and the set temperature is greater than or equal to the preset difference, the multi-split air conditioner starts the heating mode again to heat each room.

All of the above are described with the multi-split air conditioner being the execution body. In the present application, the executing body may be a server connected to the multi-split air conditioner or a control terminal connected to the multi-split air conditioner. When the execution subject is the server or the control terminal, the multi-split air conditioner will upload the indoor temperature of each target room during heating and the set temperature of each room to the server or the control terminal in real time or regularly, the server or the control terminal determines whether the indoor temperature of the target room (the server and the control terminal store the detection room set by the user) is greater than the target temperature, if the indoor temperature of the target room is greater than the target temperature, the server or the control terminal will determine the target room as a room for cooling, then generate a cooling start instruction corresponding to the room for cooling, and send the cooling start instruction to a multi-split air conditioner. After receiving the cooling start instruction, the multi-split air conditioner stops heating first, then determines the indoor unit corresponding to the room for cooling, and opens the refrigeration valve of the indoor unit and closes the refrigeration valves of other indoor units, and finally, starts the cooling mode to cool the room for cooling.

In the technical solution provided by this embodiment, when the multi-split air conditioner is heating, the target room whose temperature is too high is cooled, so that the indoor temperature in the target room is reduced, solving the problem of "the multi-split air conditioner continues to heat the room that reaches the set temperature, resulting in the room temperature being too high" in the exemplary technology, and the multi-split air conditioner can reasonably heat each room, avoiding the problem of high temperature in a room.

Figure 5:
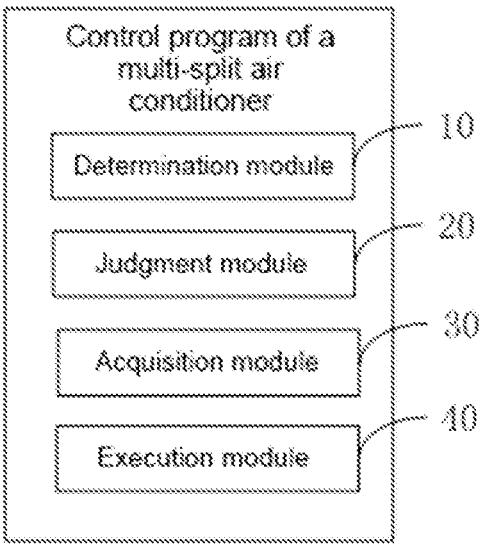
FIG. 5 is a second schematic functional module diagram of the control device of the multi-split air conditioner of the present application.

FIG. 5 is a second schematic functional module diagram of a control device of a multi-split air conditioner in the present application. Based on the control device of the multi-split air conditioner shown in FIG. 4, the control device of the multi-split air conditioner further includes: an acquisition module 30 and an executing module 40, where, the acquisition module 30 is configured to, after the multi-split air conditioner enters the heating mode, obtain an indoor temperature of each room in the action space of the multi-split air conditioner, and determine whether the indoor temperature of each room is greater than or equal to a set temperature corresponding to the room;

the execution module 40 is configured to, if not, perform the operation of determining a target room in an action space of the multi-split air conditioner;

After the multi-split air conditioner starts heating, the indoor temperature of each room will reach the set temperature. In this scenario, the multi-split air conditioner will stop heating, that is, the temperature of the room that exceeds the target temperature will not continue to rise, and there is no need to cool the room that exceeds the target temperature. It can be understood that only when the indoor temperature of a room does not reach the set temperature, the multi-split air conditioner will perform operations S10 to S30.

Based on this, after the multi-split air conditioner enters the heating mode, the multi-split air conditioner obtains the indoor temperature of each room, and then determines whether the temperature of each room is greater than or equal to the corresponding set temperature of the room, if an indoor temperature is lower than the corresponding set temperature, there is a possibility that a certain room has reached the set temperature and will continue to rise. In this scenario, the multi-split air conditioner determines the target room, to determine whether the indoor temperature of the target room is greater than the target temperature, and cool the target room when the indoor temperature of the target room is greater than the target temperature; if the temperatures of all rooms are greater than the corresponding set temperatures, the multi-split air conditioner stops heating.

In the technical solution provided in this embodiment, after obtaining the indoor temperature of each room, the multi-split air conditioner determines whether the temperature of each room is greater than or equal to the corresponding set temperature, if not, determines whether the indoor temperature of the target room is greater than the target temperature, so that the multi-split air conditioner can avoid the situation that the temperature of the target room is too high.

The present application further provides a control device of a multi-split air conditioner. The control device of the multi-split air conditioner includes a processor, a memory and a control program of a multi-split air conditioner stored in the memory and executable by the processor, when the control program of a multi-split air conditioner is executed by the processor, each operation of the control method of the multi-split air conditioner as described in the above embodiments is realized.

The application further provides a multi-split air conditioner, the multi-split air conditioner includes a processor, a memory and a control program of a multi-split air conditioner stored in the memory and executable by the processor, when the control program of the multi-split air conditioner is executed by the processor, each operation of the control method of the multi-split air conditioner as described in the above embodiments is realized.

The present application further provides a computer readable storage medium, the computer readable storage medium stores a control program of a multi-split air conditioner, the control program of a multi-split air conditioner, when executed by a processor, each operation of the control method of the multi-split air conditioner as described in the above embodiments is realized.

The sequence numbers of the above embodiments of the present application are for description only, and do not represent the advantages and disadvantages of the embodiments.

It should be noted that in this article, the terms "include," "comprise" or any other variant thereof are intended to cover non-exclusive inclusions, so that a process, method, article or device includes not only those elements, but also other elements that are not explicitly listed, or also elements inherent in such a process, method, article or device. In the absence of more restrictions, qualified elements by the statement "including a . . . " do not exclude the existence of other identical elements in the process, method, article or device that includes the element.

Through the description of the above embodiments, those skilled in the art can clearly understand that the methods in the above embodiments can be implemented by means of software plus a necessary general hardware platform, and of course, can also be implemented by hardware, but in many cases the former is better. Based on this understanding, the part of the technical solution of the present application that essentially or contributes to the existing technology can be reflected in the form of software products, the computer software product is stored in a storage medium (e.g., ROM/RAM, disk, CD) as described above, and includes a number of instructions to enable a terminal device (which can be a mobile phone, computer, server, air conditioner, or network equipment, etc.) to execute the method described in each embodiment of the present application.

The above is only optional embodiments of the present application, and does not therefore limit the scope of the patent of the present application, and any equivalent structure or equivalent process transformation using the contents of the present application specification and drawings, or direct or indirect using in other related technical fields, is all included in the claimed scope of the present application.

What is claimed:

1. A control method comprising:

after a multi-split air conditioner starts to operate in a heating mode, determining a target room from a plurality of rooms for which the multi-split air conditioner provides air conditioning, and obtaining an indoor temperature of the target room;

determining whether the indoor temperature of the target room is greater than a target temperature corresponding to the target room;

in response to a determination that the indoor temperature of the target room is greater than the target temperature, controlling the multi-split air conditioner to switch an operation mode of a target indoor unit corresponding to the target room from the heating mode to a cooling mode;

determining, every preset time interval, whether a current indoor temperature in the target room is lower than a set temperature;

calculating a difference between the set temperature and the current indoor temperature in response to a determination that the current indoor temperature is lower than the set temperature; and controlling the multi-split air conditioner to switch from the cooling mode to the heating mode in response to a determination that the difference is greater than a preset difference, the preset difference being determined based on a heating rate of the target room, the set temperature corresponding to the target room, a heating rate of a room with a lowest temperature among the plurality of rooms, a set temperature corresponding to the room with the lowest temperature, and a current temperature of the room with the lowest temperature.

2. The control method according to claim 1, wherein controlling the multi-split air conditioner to switch the operation mode of the target indoor unit includes:

controlling the multi-split air conditioner to stop heating;

controlling a refrigeration valve of the target indoor unit to open and a refrigeration valve of each of other one or more indoor units corresponding to other one or more of the plurality of rooms to close; and controlling the multi-split air conditioner to start to operate in the cooling mode to cool the target room.

3. The control method according to claim 1, wherein controlling the multi-split air conditioner to switch the operation mode of the target indoor unit includes:

generating a cooling start instruction corresponding to the target room; and sending the cooling start instruction to the multi-split air conditioner so that the multi-split air conditioner, upon receiving the cooling start instruction, stops heating, opens a refrigeration valve of the target indoor unit and closes a refrigeration valve of each of other one or more indoor units corresponding to other one or more of the plurality of rooms, so as to start to operate in the cooling mode to cool the target room.

4. The control method according to claim 1, further comprising, before determining whether the indoor temperature is greater than the target temperature:

obtaining the set temperature for the target room set by a user; and determining the target temperature according to the set temperature, the target temperature being greater than the set temperature.

5. The control method according to claim 4, wherein determining the target temperature according to the set temperature includes:

obtaining an offset; and obtaining the target temperature by calculating a sum of the set temperature and the offset.

6. The control method according to claim 1, further comprising:

after the multi-split air conditioner starts to operate in the heating mode, obtaining an indoor temperature of each room of the plurality of rooms, and determining whether the indoor temperature of each room is greater than or equal to a corresponding set temperature corresponding to the room;

wherein determining the target room includes determining the target room in response to a determination that the indoor temperature of at least one of the plurality of rooms is lower than the corresponding set temperature.

7. The control method according to claim 6, further comprising, after determining whether the indoor temperature of each room is greater than or equal to the set temperature corresponding to the room:

controlling the multi-split air conditioner to stop heating in response to a determination that the indoor temperature of each room is greater than or equal to the set temperature corresponding to the room.

8. The control method according to claim 1, wherein refrigeration valves of various indoor unit of the multi-split air conditioner are configured to be individually closed and individually opened, and heating valves of the various indoor units are configured to be simultaneously closed and simultaneously opened.

9. A non-transitory computer readable storage medium storing a multi-split air conditioner control program that, when executed by a processor, causes the processor to perform the control method according to claim 1.

10. A control device of a multi-split air conditioner comprising:

a processor; and a non-transitory memory storing a control program of the multi-split air conditioner that, when executed by the processor, causes the processor to:

after the multi-split air conditioner starts to operate in a heating mode, determine a target room from a plurality of rooms for which the multi-split air conditioner provides air conditioning, and obtain an indoor temperature of the target room determine whether the indoor temperature of the target room is greater than a target temperature corresponding to the target room;

in response to a determination that the indoor temperature of the target room is greater than the target temperature, control the multi-split air conditioner to switch an operation mode of a target indoor unit corresponding to the target room from the heating mode to a cooling mode;

determine, every preset time interval, whether a current indoor temperature in the target room is lower than a set temperature;

calculate a difference between the set temperature and the current indoor temperature in response to a determination that the current indoor temperature is lower than the set temperature; and control the multi-split air conditioner to switch from the cooling mode to the heating mode in response to a determination that the difference is greater than a preset difference, the preset difference being determined based on a heating rate of the target room, the set temperature corresponding to the target room, a heating rate of a room with a lowest temperature among the plurality of rooms, a set temperature corresponding to the room with the lowest temperature, and a current temperature of the room with the lowest temperature.

11. A multi-split air conditioner comprising:

the control device according to claim 10.

12. The multi-split air conditioner according to claim 11, wherein the control program further causes the processor to:

control the multi-split air conditioner to stop heating;

control a refrigeration valve of the target indoor unit to open and a refrigeration valve of each of other one or more indoor units corresponding to other one or more of the plurality of rooms to close; and control the multi-split air conditioner to start to operate in the cooling mode to cool the target room.

13. The multi-split air conditioner according to claim 11, wherein the control program further causes the processor to, before determining whether the indoor temperature is greater than the target temperature:

obtain the set temperature for the target room set by a user; and determine the target temperature according to the set temperature, the target temperature being greater than the set temperature.

14. The multi-split air conditioner according to claim 11, wherein the control program further causes the processor to:

after the multi-split air conditioner starts to operate in the heating mode, obtain an indoor temperature of each room of the plurality of rooms, and determine whether the indoor temperature of each room is greater than or equal to a corresponding set temperature corresponding to the room; and determine the target room in response to a determination that the indoor temperature of at least one of the plurality of rooms is lower than the corresponding set temperature.

15. The multi-split air conditioner according to claim 11, wherein refrigeration valves of various indoor unit of the multi-split air conditioner are configured to be individually closed and individually opened, and heating valves of the various indoor units are configured to be simultaneously closed and simultaneously opened.

* * * * *